US007938134B2

(12) United States Patent
Adams

(10) Patent No.: US 7,938,134 B2
(45) Date of Patent: May 10, 2011

(54) PROTECTIVE SHELTER

(76) Inventor: Paul Adams, Enumclaw, WA (US)

( * ) Notice: Subject to any disclaimer, the term of this patent is extended or adjusted under 35 U.S.C. 154(b) by 232 days.

(21) Appl. No.: 12/058,514

(22) Filed: Mar. 28, 2008

(65) Prior Publication Data

US 2009/0242009 A1 Oct. 1, 2009

(51) Int. Cl.
*E04H 15/36* (2006.01)
*E04H 15/58* (2006.01)

(52) U.S. Cl. ..... 135/124; 135/117; 135/120.3; 135/906; 135/138; 52/86; 52/63

(58) Field of Classification Search ..... 135/124, 135/132, 136, 138, 152–154, 117, 906, 121, 135/120.3; 52/27.5, 65–66, 79.5–79.8, 88, 52/63, 74, 83, 86; 473/478; 47/17, 20.1, 47/29.1; 403/102
See application file for complete search history.

(56) References Cited

U.S. PATENT DOCUMENTS

| | | | | | |
|---|---|---|---|---|---|
| 331,756 | A | * | 12/1885 | Baker | 473/478 |
| 1,745,264 | A | * | 1/1930 | Margot et al. | 135/133 |
| 1,819,490 | A | * | 8/1931 | Weiss | 135/132 |
| 2,975,792 | A | * | 3/1961 | Herbert et al. | 135/153 |
| 3,114,376 | A | * | 12/1963 | Rexroat | 135/121 |
| 3,155,427 | A | * | 11/1964 | Necessary | 297/184.14 |
| 3,405,721 | A | * | 10/1968 | Crosier et al. | 135/130 |
| 4,355,650 | A | | 10/1982 | Beaudry | |
| 4,453,558 | A | * | 6/1984 | Ochs et al. | 135/121 |
| 4,612,948 | A | * | 9/1986 | Simpson | 135/130 |
| 4,692,847 | A | * | 9/1987 | Gandy | 362/152 |
| 4,817,655 | A | * | 4/1989 | Brooks | 135/121 |
| 5,242,004 | A | * | 9/1993 | Stilling | 160/57 |
| 5,580,064 | A | * | 12/1996 | Childers, Jr. | 273/400 |
| 5,785,333 | A | * | 7/1998 | Hinkston et al. | 280/204 |
| 5,927,363 | A | * | 7/1999 | Olsen | 160/83.1 |
| 7,178,540 | B2 | | 2/2007 | Eder | |
| 2006/0081285 | A1 | * | 4/2006 | Gomez | 135/134 |

FOREIGN PATENT DOCUMENTS

| | | | | |
|---|---|---|---|---|
| DE | 4214718 | A1 | * | 11/1993 |
| JP | 2005155074 | A | * | 6/2005 |

* cited by examiner

*Primary Examiner* — Winnie Yip
(74) *Attorney, Agent, or Firm* — Black Lowe & Graham PLLC

(57) ABSTRACT

A protective shelter that may be used to protect observers, players, and others from inclement weather during a sporting event, for example, includes an arcuate-shaped, flexible cover with side portions configured to receive side frame members, which in turn are connected to elongated cover support members coupled to the cover. The various frame members and cover support members may be connected with a number of different types of couplers. In addition, a majority of the side frame members and support members may remain coupled to the flexible cover after the protective shelter has been disassembled and placed in a transportable configuration.

14 Claims, 8 Drawing Sheets

PROTECTIVE SHELTER

FIELD OF THE INVENTION

This invention relates generally to a protective shelter and methods of assembling the same, and more specifically to protective shelters that may be readily assembled, disassembled and transported by a person.

BACKGROUND OF THE INVENTION

Conventional shelters for protection against various weather-related elements, such as sun, rain, wind, snow, etc. may come in a variety of shapes, sizes, and have varying degrees of complexity related to the assembly or disassembly of the shelter. By way of example, U.S. Pat. No. 4,355,650 to Beaudry describes a conventional shelter that takes the form of a portable and collapsible shelter having a plurality of support ribs or bows which are pivotally mounted to a hub at each end thereof. Each rib is made up of at least three completely separable pieces. The fabric covering of the structure provides compressive forces to the bows to maintain the assembled condition of the bows.

When erected, the structure is maintained in an open position by a pair of side braces positioned at the vertical sides of the structure. A first side brace is pivotally attached to the rib which rests on the ground; a second brace is pivotally attached to the rib forming the entrance to the structure. The braces are pivotally attached to each other at their other ends by a rivet. A keyhole slot is provided in the center rib for purposes of receiving the head of the rivet attaching the two braces to each other. The large portion of the keyhole slot is positioned closest to the hub while the smaller elongated portion of the slot extends away from the hub. When the ribs or bows are fully fanned out, the head of the aforementioned rivet fits within the elongated portion of the keyhole slot and the braces form an angle with each other with the apex of the angle extending away from the hub.

The outer covering of the shelter is then snap fastened to the first and last bows. The resulting tautness of the outer covering provides a force which tends to cause the bows to collapse. Such force, however, in conjunction with the angle formed by the braces, firmly locks the rivet head within the elongated portion of the keyhole slot and thereby prevents the structure from collapsing.

A combination digging tool and anchor prevents the structure from being moved by the wind when erected. A tie rod is pivotally attached to each hub and extends therefrom into the ground. A small trench is dug into the ground at the location of the hub with the aid of the combination tool. When an appropriate depth is achieved, the tool is engaged with the tie rod, forming an inverted "T" within the trench. The trench is then backfilled with earth or sand which buries the anchor within the covered over trench.

During assembly, the bows are connected to form five "U"-shaped bows. Next, the bows are fully fanned out by applying a force to the pinned braces in a direction away from the hub. The inherent collapsing action of the bows together with the angle formed by the braces causes a connection rivet to maintain its position at the end of a keyhole slot, which end is furthermost away from the hub. At this point of the erection sequence of shelter, the fabric covering is draped over the framework of shelter and then snap fitted to one or more bows. The interrelating forces of the bows, the fabric covering, and the braces as they act and react with each other maintains the shelter in a fully erected position.

U.S. Pat. No. 7,178,540 to Eder describes an improved hub for a personal shelter or canopy. The hub includes a number of spherical rotating joint elements captured in a hub body. The joint elements provide rotational movement of canopy frame elements to allow easy opening and collapsing of a canopy frame and cover. Two canopy hubs are preferably connected along a common axis by a rigid cross bar. Each hub may be formed by molding in high-density plastic and combined with stub arms to facilitate subsequent assembly of a completed canopy.

SUMMARY OF THE INVENTION

The present invention relates to a protective shelter. More specifically and in one embodiment, the present invention relates to a transportable protective shelter having an arcuate-shaped, flexible cover with side portions configured to receive side frame members, which in turn are connected to elongated cover support members coupled to the cover. The various frame members and support members may be connected with different types of couplers or connectors. In one embodiment, only several of the members are removable while the others remain with the cover and may be folded up in situ.

In accordance with an aspect of the invention, a protective shelter includes an arcuate-shaped cover made from a flexible material, the cover extending from a first side portion to a second side portion; two side frames each respectively coupled to the first and second side portions of the cover, each side frame having a removable, arcuate-shaped structural member coupled to two radially extending structural members each fixed to the cover, each side frame further having a diagonal member with a first end coupled to a central hub member and a second end coupled to the arcuate-shaped structural member; an elongated top-front structural member extending from the one side frame to the other side frame and having a first pivot connector, the top-front structural member fixed to the cover to provide horizontal tension to the flexible material of the cover and to maintain the side frames in a spaced apart relationship from one another when the shelter is in an operating configuration, the first pivot connector having a pinned connection for permitting the elongated top-front structural member to be folded; and an elongated bottom-rear structural member extending from the one side frame to the other side frame and having second pivot connector, the bottom-back structural member coupled to the cover to provide horizontal tension to the flexible material of the cover and to maintain the side frames in a spaced apart relationship from one another when the shelter is in the operating configuration, the second pivot connector having a pinned connection for permitting the elongated bottom-back structural member to be folded.

In accordance with another aspect of the invention, a protective shelter includes an arcuate-shaped cover having a top portion that extends continuously into a back portion, the cover made from a flexible material, the cover extending substantially horizontally from a first side portion to a second side portion; two side frames each respectively coupled to the first and second side portions of the cover, each side frame having an arcuate-shaped structural member coupled to two radially extending structural members, the arcuate-shaped structural member cooperating with the respective side portion of the cover to provide circumferential tension to the flexible material of the cover, the two radially extending structural members coupled to and extending from a central hub, each side frame further having an intermediate structural member having a first end coupled to the central hub and a second end coupled to the arcuate-shaped structural member, the intermediate structural member circumferentially located between the two radially extending structural members; an elongated top-front structural member extending from the one side frame to the other side frame, the top-front structural member coupled to the cover to provide horizontal tension to the flexible material of the cover and to maintain the side frames in a spaced apart relationship from one another; and an elongated bottom-rear structural member extending from the one side frame to the other side frame, the bottom-back structural member coupled to the cover to provide horizontal tension to the flexible material of the cover and to maintain the side frames in a spaced apart relationship from one another.

In accordance with another aspect of the invention, a method of assembling a protective shelter includes the steps of (1) connecting an elongated top-front structural member to the front edge of the flexible cover and an elongated bottom-back structural member to the back edge of the flexible cover, the top-front and bottom-back structural members configured to tension the cover in a direction substantially parallel to a longitudinal axis of at least one of the top-front and bottom-back structural members; (2) coupling a first arcuate-shaped structural member to one side edge of the cover and to the top-front and bottom-back structural members; (3) coupling a second arcuate-shaped structural member to the other side edge of the cover and to the top-front and bottom-back structural members; (4) rotating the top-front structural member away from the bottom-back structural member about a shelter rotation axis extending horizontally through first and second central hubs corresponding to the respective first and second arcuate-shaped structural members; (5) coupling a tensioning member with the flexible cover; and moving the assembled protective shelter to a desired location.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

As will be described in further detail below, at least one embodiment of the invention includes a protective shelter that may be used to protect observers, players, and others from inclement weather during a sporting event, for example, includes an arcuate-shaped, flexible cover with side portions configured to receive side frame members, which in turn are connected to elongated cover support members coupled to the cover. The various frame members and cover support members may be connected with a number of different types of couplers. In addition, a majority of the side frame members and support members may remain coupled to the flexible cover after the protective shelter has been disassembled and placed in a transportable configuration.

Figure 1:
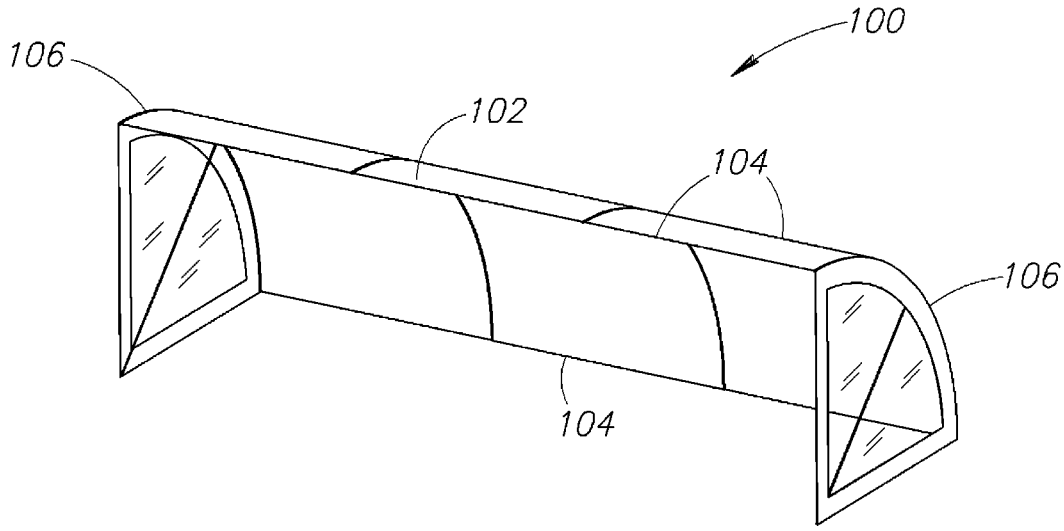
FIG. 1 is an isometric view of a protective shelter according to an embodiment of the present invention.
Figure 2:
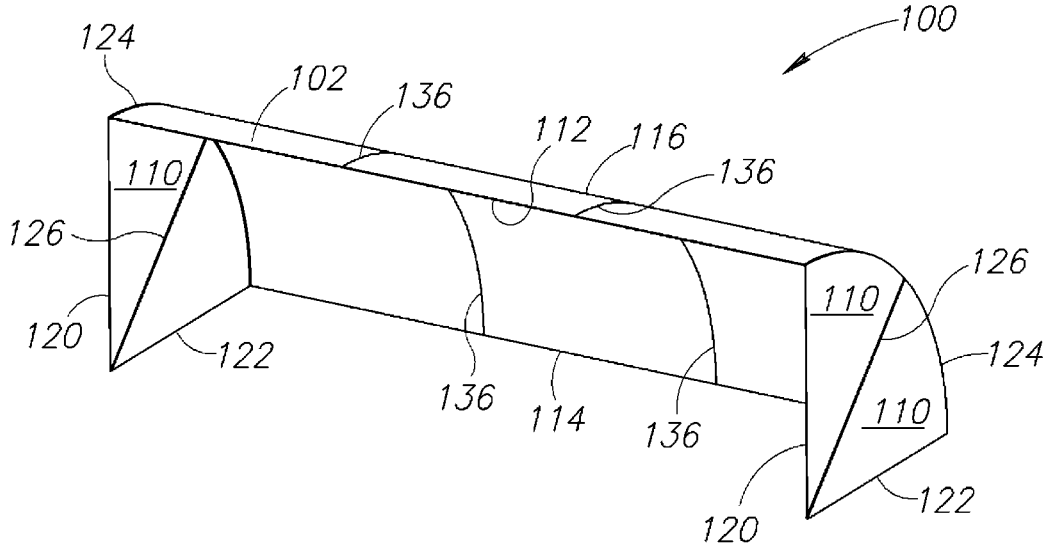
FIG. 2 is an isometric view of the protective shelter of FIG. 1 showing the locations of the various cover and side support members.
Figure 3:
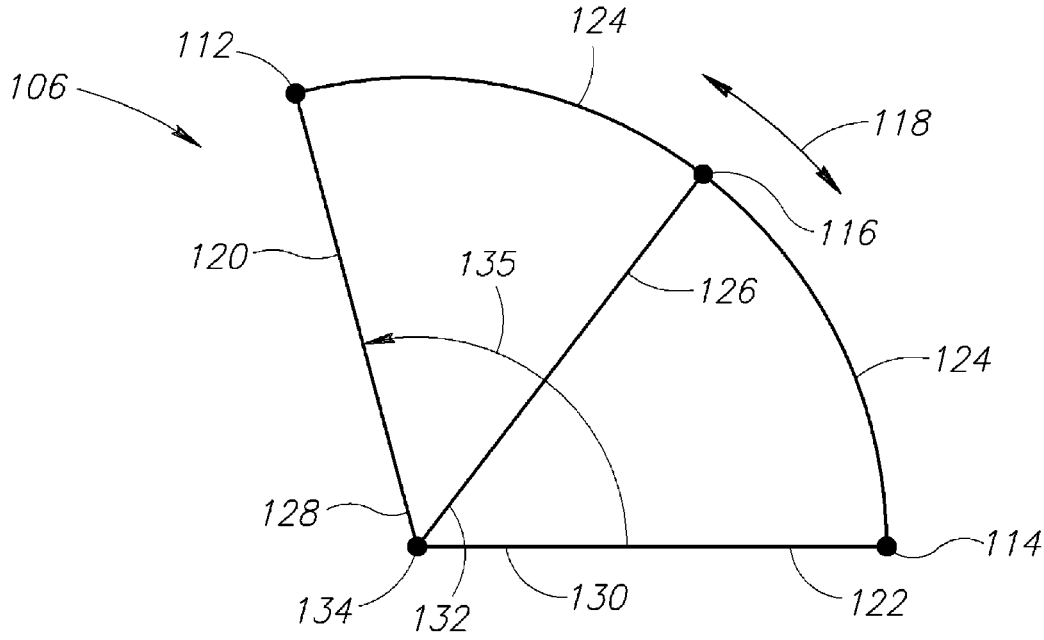
FIG. 3 is a side elevational view of a side frame of the protective shelter of FIG. 1.

FIGS. 1-3 show a protective shelter 100 having a flexible cover 102 supported by a plurality of cover support members 104 and side frames 106 according to an illustrated embodiment of the present invention. The flexible cover 102 may take the form of a one-piece cover having an arcuate-shaped covering portion 108 and side covering portions 110. The arcuate shape of the covering portion 108 may approximately take the shape of, but is not limited to, a quarter-circle segment (e.g. 90 degrees from a back, bottom portion to a top, front portion) or larger angled segment. The cover 102 may be made from a variety of flexible materials, such as but not limited to, nylon taffeta, nylon oxford, rip stop nylon, Gore-Tex®, Nomex®, and other equivalent materials. Nevertheless, the cover 102, in its entirety, may be sufficiently light weight to be transported by a single person when the shelter 100 is placed in a transportable or carrying configuration, yet also sufficiently durable to be folded, rolled, pulled, and/or stretched while the shelter 100 is being set up in an operating configuration or being packaged into the transportable configuration.

Now referring primarily to FIGS. 2 and 3, the plurality of cover support members 104 may include an elongated top-front structural member 112 and an elongated bottom-back structural member 114. In addition, the cover support members 104 may include one or more tensioning members 116 coupled to the cover 102 and located in a circumferentially intermediate position between the top-front structural member 112 and the bottom-back structural member 114 as best shown in FIG. 3, where the circumferential direction is indicated by a circumferential direction arrow 118.

The side frames 106 support the side covering portions 110 of the protective shelter 100. In one embodiment, each side frame 106 includes a front-side structural member 120, a bottom-side structural member 122, an arcuate or arch-shaped structural member 124, and at least one diagonal or radially-extending structural member 126. The front-side, bottom-side, and diagonal radially-extending members 120, 122, and 126 include respective first end portions 128, 130, and 132 each coupled to a hub device 134, which is schematically shown in FIG. 3 and is described in greater detail below. An angle 135 between the bottom-side radially-extending member 122 (i.e., horizontal) and the front-side radially-extending member 120 (i.e., vertical) may be in a range of about 75-140 degrees and preferably in a range of about 90-120 degrees. In a preferred embodiment, the angle 135 is about 110 degrees, which provides sufficient structural stability and an adequate overhang portion to protect occupants of the shelter from various types of weather.

In one embodiment, the protective shelter 100 with the top-front structural member 112, the bottom-back structural member 114 and the tensioning member 116 may be interconnected with arcuate or arch-shaped intermediate members 136. In the illustrated embodiment two intermediate members 136 are used, but this number may vary depending on the length of the shelter 100 and/or on the environment in which the shelter 100 is employed.

One or more of the members described above may take the form of lightweight, hollow, aluminum alloy members, advanced composite members, plastic members, or some equivalent thereof. Advanced composite members may include any type of structural fiber material combined with a resin, for example graphite fibers reinforced or embedded in an epoxy resin. Further, the members may take the form of poles, rods, or tubes that may or may not have a circular cross section. By way of example, the members may be segmented such that each segment is coupled to an adjacent segment and all the segments of a particular member are connected by a stretchable cord that extends through the hollow portion thereof. Alternatively stated, the members may be configured similar to and operate like segmented tent poles. In one embodiment, a number of the members may be fixed to the cover 102, for example bonded to or sewn into respective pockets of the cover 102. Fixing at least a number of members to the cover 102 may help reduce the number of loose parts that must be handled during assembly/disassembly of the shelter 100.

Figure 4:
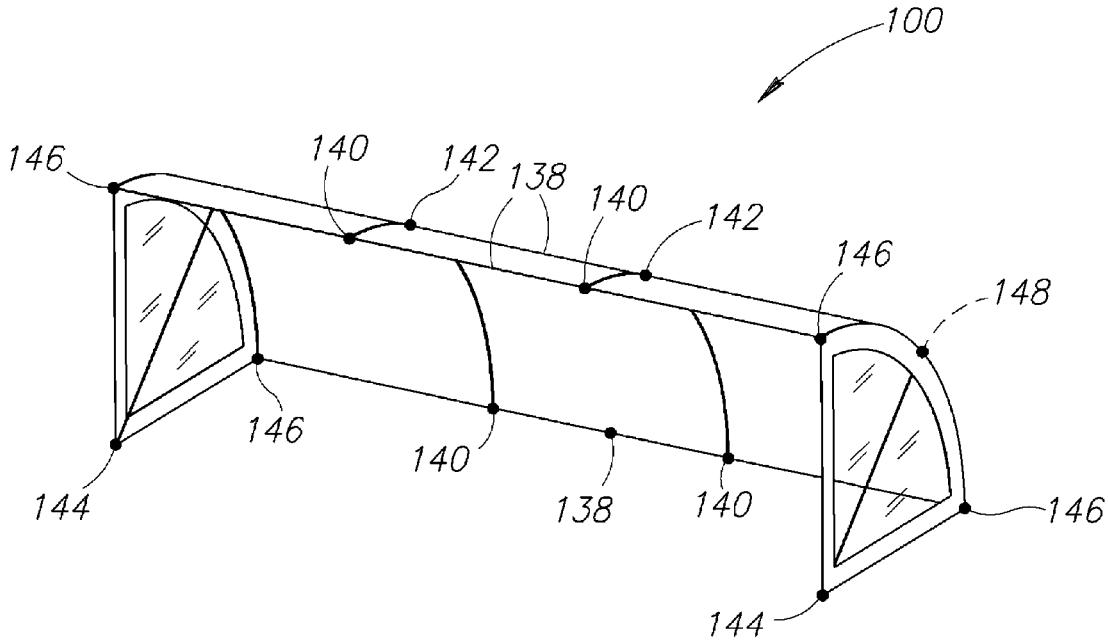
FIG. 4 is an isometric view of the protective shelter of FIG. 1 showing the locations of the various connectors used in the shelter.

FIG. 4 schematically shows several different types of connectors and their locations with respect to the shelter 100. The connectors are used to join the various members described above with one another and/or with the cover 102. In one embodiment, the elongated top-front structural member 112, the elongated bottom-back structural member 114, and the tensioning member 116 may each be comprised of two or more members interconnected with a slide-locking bent tongue connector 138. The intermediate members 136 are coupled to the elongated top-front structural member 112 and the elongated bottom-back structural member 114 using snap T-connectors 140. The intermediate members 136 are coupled to the tensioning member 116 using snap saddle connectors 142. The front-side structural member 120 and the bottom-side structural member 122 are coupled together using a hub or complex connector 144. The elongated top-front structural member 112 and the elongated bottom-back structural member 114 are each coupled to the side frames 106 using tri-connectors 146. Likewise, the tensioning member 116 is coupled to the side frames 106 using a straight tongue connector 148 and an elbow-shaped saddle connector 150.

Figure 5:
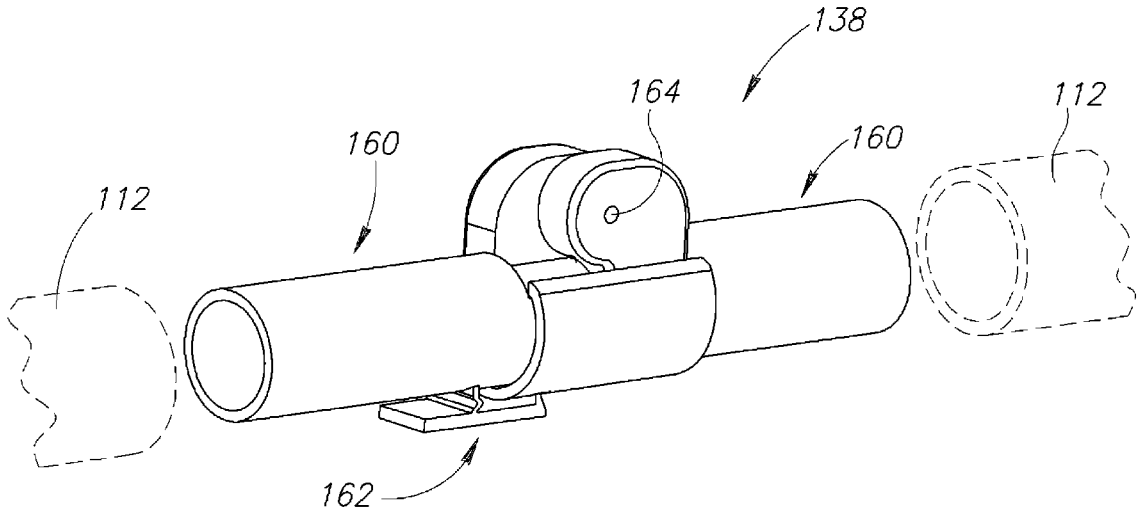
FIG. 5 is an isometric view of a slide-locking bent tongue connector according to an embodiment of the present invention.

FIG. 5, by way of example, shows the slide-locking bent tongue connector 138 attaching two top-front structural members 112. The connector 138 includes bent-tongue portions 160 and a slide-locking collar 162. In the illustrated embodiment, two bent-tongue portions 160 are arranged in opposing directions such that they may be pin connected together through opening 164. Extending portions 166 may be bonded to the two top-front structural members 112. Removing a pin (not shown) from the connector 138 permits the shelter 100 to be folded. The slide lock collar 162 locks the two bent-tongue portions 160 together when the shelter 100 is in an operating configuration. The slide lock collar 162 provide structural support to the joint and functions to reduce flexing or opening of the joint.

Figure 6:
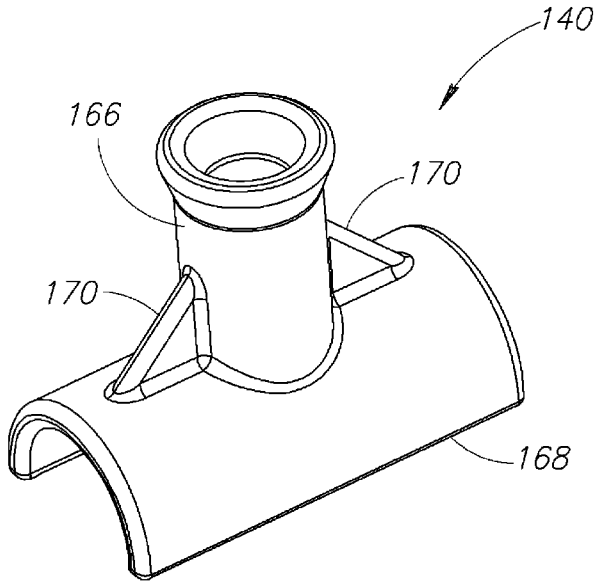
FIG. 6 is an isometric view of a snap T-connector according to an embodiment of the present invention.

FIG. 6 shows, by way of example, the snap T-connector 140 used to couple the intermediate members 136 to the elongated top-front structural member 112 and the elongated bottom-back structural member 114. The snap T-connector 140 includes a pole or rod coupling portion 166 for engaging the intermediate member 136 and a saddle or snap portion 168 for engaging the top-front and bottom-back structural members 112, 114, respectively. For additional structural support, the snap T-connector 140 may include gussets or ribs 170 that extend between the rod coupling portion 166 and the snap portion 168.

Figure 7:
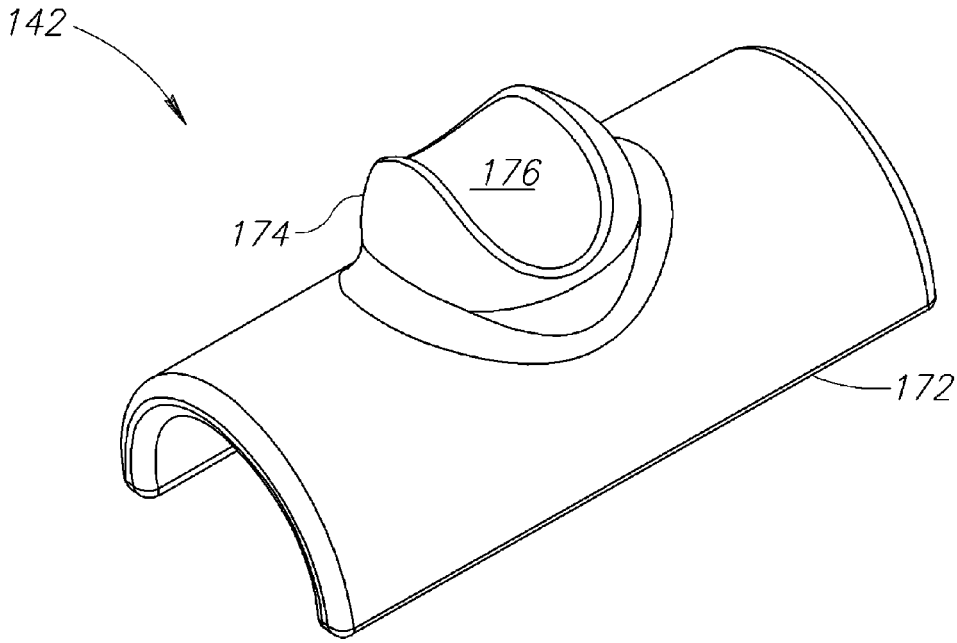
FIG. 7 is an isometric view of a snap saddle connector according to an embodiment of the present invention.

FIG. 7 shows, by way of example, the snap saddle 142 for coupling the intermediate members 136 to the tensioning member 116. The snap saddle 142 includes a snap portion 172 to receivably support a portion of the tensioning member 116 and a protuberance 174 extending from the snap portion 172. The protuberance 174 includes a contoured surface 176 configured to engage a portion of the intermediate member 136.

Figure 8:
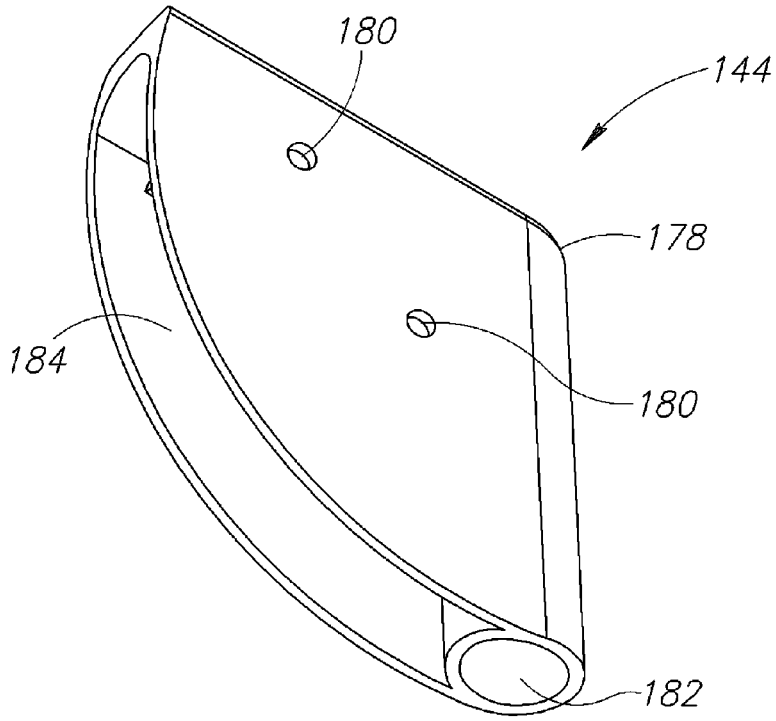
FIG. 8 is an isometric view of complex connector according to an embodiment of the present invention.

FIG. 8 shows, by way of example, the complex connector 144, which operates as a central hub for the side frames 106. The complex connector 144 includes a body 178 having openings 180 for receiving pins (not shown). The body 178 includes a bore 182 sized to receive the bottom-side structural member 122. The body 178 further includes a channel 184 sized to receive straight tongue connectors 148 (FIG. 10), one attached to the front-side structural member 120 and another attached to the radially-extending structural member 126. The pins coupled the straight tongue connectors 148 to the body 178. The channel 184 may be configured to permit the front-side structural member 120 and the radially-extending structural member 126 to pivot or be moved within the channel 184, which in turn permits the shelter 100 to be raised or lowered.

Figure 9:
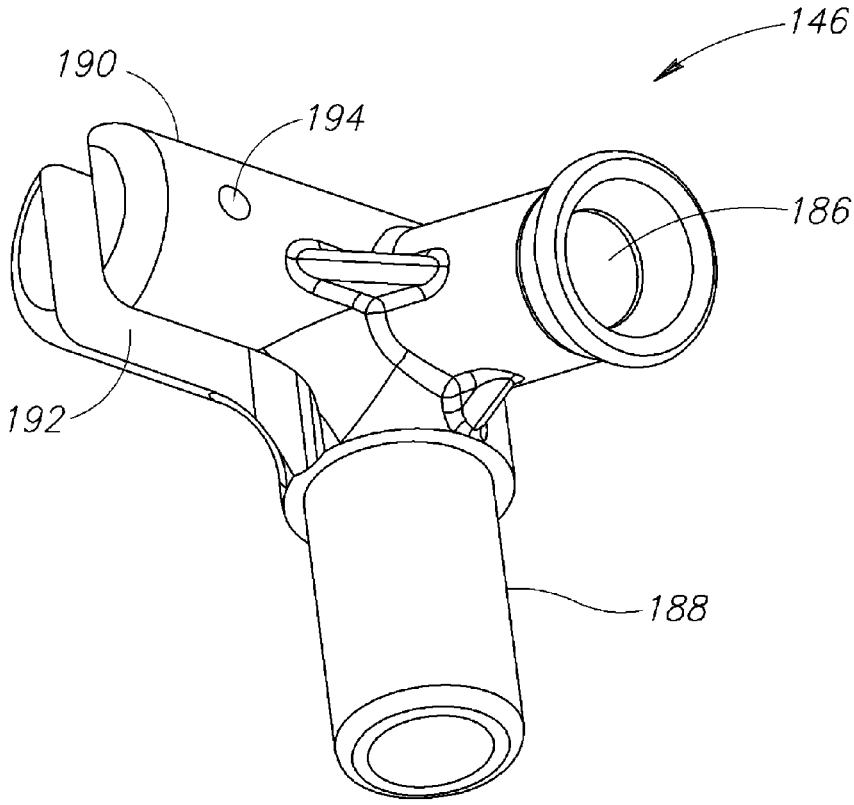
FIG. 9 is an isometric view of a tri-connector according to an embodiment of the present invention.

FIG. 9 shows, by way of example, the tri-connector 146 for coupling the front-side structural member 120 and the arch-shaped structural member 124 of the side frame 106 to the top-front structural member 112. In the illustrated embodiment, the tri-connector 146 includes a receiving bore 186, a receiving barrel 188, and a slotted portion 190. The bore 186, barrel 188 and slotted portion 190 may be arranged orthogonally with respect to one another or may be arranged with other angles depending on the configuration of the shelter 100. The slotted portion 190 includes a slot 192 and a pin opening 194, each configured to engage a straight tongue connector 148 (FIG. 10).

Figure 10:
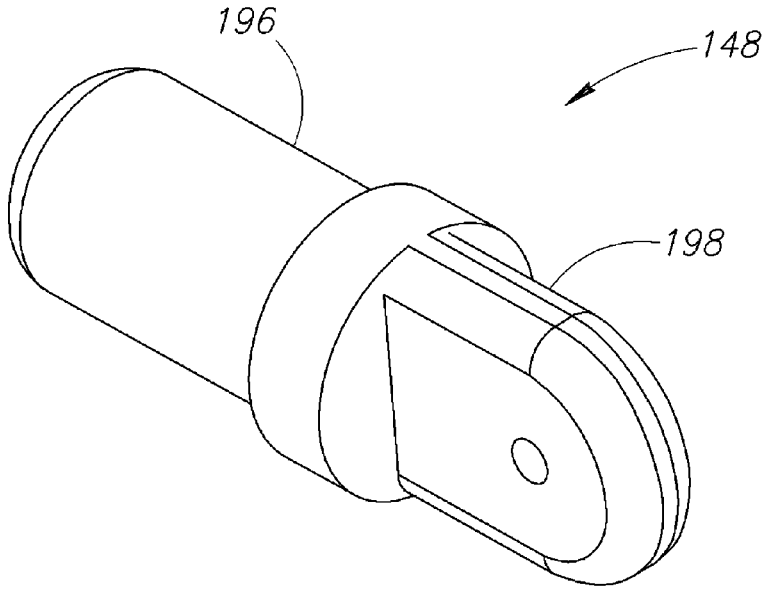
FIG. 10 is an isometric view of a straight tongue connector according to an embodiment of the present invention.

FIG. 10 shows the straight connector 148, which is used mainly as an intermediate connector as explained above. The straight connector 148 includes a barrel portion 196 and a tongue portion 198 extending from the barrel portion 196. The straight connector 148 may cooperate with other connectors or may be used independently thereof.

Figure 11:
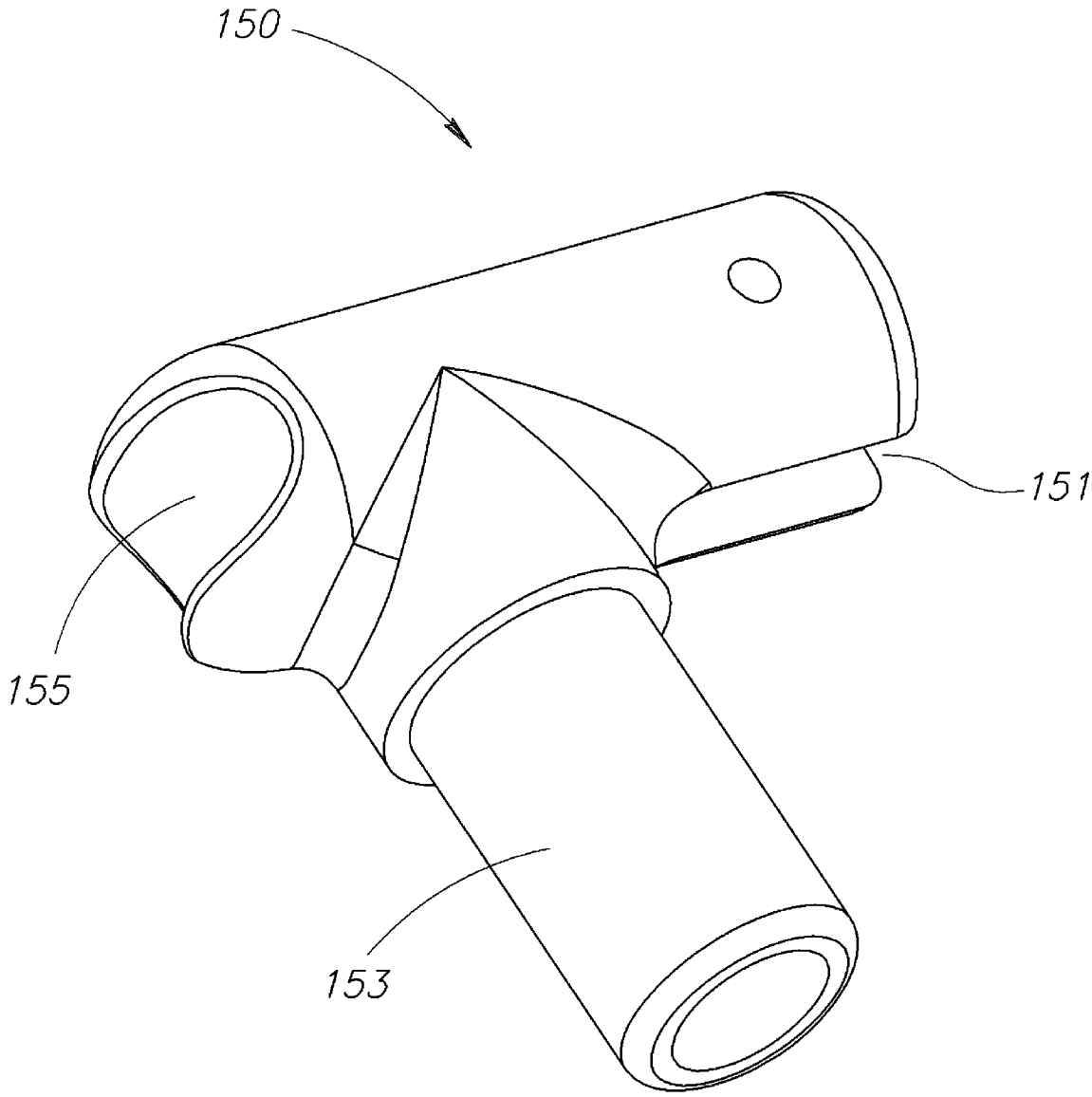
FIG. 11 is an isometric view of elbow-shaped saddle connector according to an embodiment of the present invention.

FIG. 11 shows the elbow-shaped saddle connector 150 having a slot 151, a barrel portion 153, and a recessed portion 155. By way of example, the slot 151 receives the straight tongue connector 148, which in turn couples to the diagonal radially-extending member 126, the barrel portion 153 receives the tensioning member 116, and the recessed portion 155 receives the arch-shaped structural member 124.

Figure 12:
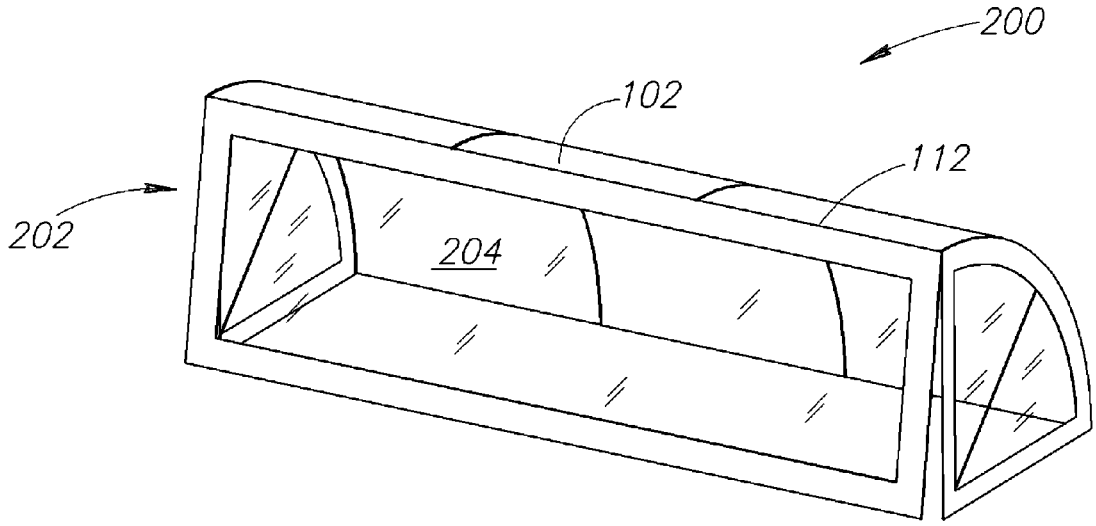
FIG. 12 is an isometric view of a shelter having a front flap according to another embodiment of the present invention.

FIG. 12 shows a shelter 200 having a front flap 202 with a see-through portion 204. The shelter 200 is structurally and functionally similar to the shelter 100 described above except for the addition of the front flap 202. Accordingly, the structure of the shelter 200 will not be re-described herein. In the illustrated embodiment, the front flap 202 may be hingedly attached to the top-front structural member 112 or may be stitched or otherwise attached to the cover 102.

Figure 13:
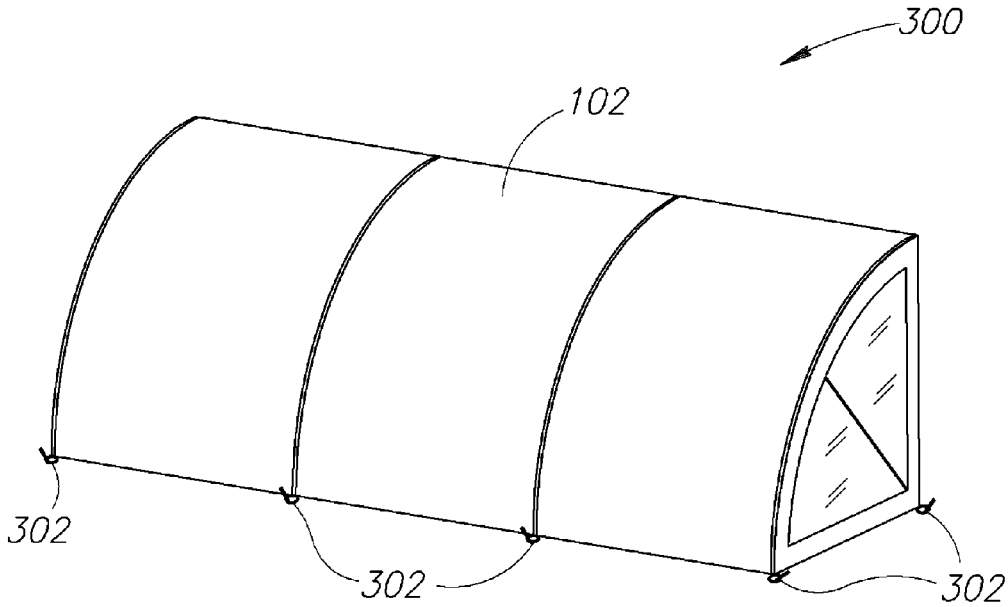
FIG. 13 is an isometric view of a shelter having a anchoring devices according to another embodiment of the present invention.

FIG. 13 shows a shelter 300 having anchoring devices 302 attached to the various joints of the shelter 300. The shelter 300 is structurally and functionally similar to the shelter 100 described above except for the addition of the anchoring devices 302. Accordingly, the structure of the shelter 300 will not be re-described herein. The anchoring devices 302 may take the form of rods received into the ground with an adjustable cord that attaches to the rod and to reinforce portions of the cover 102 or to one or more of the connectors described above.

Figure 14:
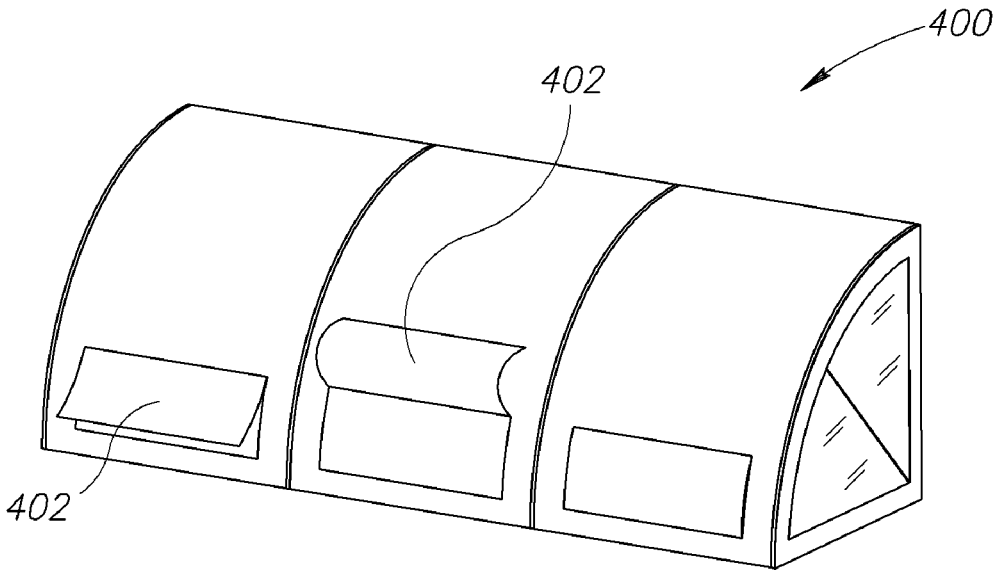
FIG. 14 is an isometric view of a shelter having rear flaps according to another embodiment of the present invention.

FIG. 14 shows a shelter 400 having rear flaps 402 that may be opened and closed. The flaps 402 may be rolled up and tied to provide additional ventilation through the shelter 400.

Figure 15:
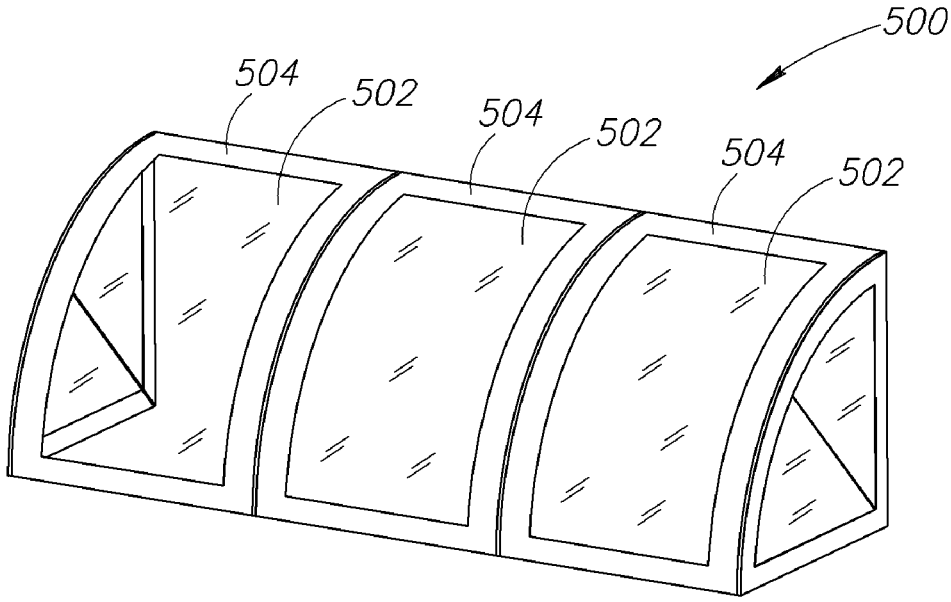
FIG. 15 is an isometric view of a shelter having rear window panels according to another embodiment of the present invention.

FIG. 15 shows a shelter 500 having rear windows 502. In the illustrated embodiment, the rear windows 502 are sized to take up most of the respective panels 504. However, the size of the rear windows 502 may be smaller than illustrated and may be in other configurations besides rectangular.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A protective shelter comprising:

an arcuate-shaped cover made from a flexible material, the cover extending from a first side portion to a second side portion;

two side frame assemblies each respectively coupled to the first and second side portions of the cover, each side frame assembly having a removable, arcuate-shaped structural member coupled to two radially extending structural members each fixed to the cover, each side frame assembly further having a diagonal member;

an elongated top-front structural member extending from the one side frame assembly to the other side frame assembly, the top-front structural member fixed to the cover to provide horizontal tension to the flexible material of the cover and to maintain the side frame assemblies in a spaced apart relationship from one another when the shelter is in an operating configuration;

an elongated bottom-rear structural member extending from the one side frame assembly to the other side frame assembly, the bottom-rear structural member coupled to the cover to provide horizontal tension to the flexible material of the cover and to maintain the side frame assemblies in a spaced apart relationship from one another when the shelter is in the operating configuration; and a tongue connector having a barrel portion and a tongue portion, the barrel portion engageable with at least one of the radially extending structural members of the side frame assemblies; and a hub connector having a channel configured to pivotally receive the tongue portion of the tongue connector, the hub connector further having a bore for receiving the other one of the radially extending structural members.

2. The protective shelter of claim 1, wherein the arcuate-shaped structural member cooperates with the respective side portion of the cover to provide circumferential tension to the flexible material of the cover.

3. The protective shelter of claim 1, wherein the two radially extending structural members are bonded to the cover.

4. The protective shelter of claim 1, wherein the elongated top-front structural member is bonded to the cover.

5. The protective shelter of claim 4 wherein the arcuate-shaped cover includes a first portion of a snap system located proximate the elongated top-front structural member, the first portion configured to removably attach to a corresponding portion coupled to a front flap.

6. The protective shelter of claim 1, wherein the elongated bottom-rear structural member is bonded to the cover.

7. The protective shelter of claim 1, wherein a portion of the cover includes a substantially transparent material.

8. The protective shelter of claim 1, wherein at least one of the first side portion or the second side portion of the cover includes a substantially transparent material.

9. The protective shelter of claim 1, wherein the flexible material of the cover is foldable to be transportable by a person.

10. The protective shelter of claim 1 wherein the arcuate-shaped cover includes at least one access flap configured to be movable from an open position to a closed position when the protective shelter is erected.

11. The protective shelter of claim 1, further comprising:

a front flap coupled to the arcuate-shaped cover proximate the elongated top-front structural member.

12. The protective shelter of claim 11 wherein the front flap is hingedly coupled to the arcuate-shaped cover.

13. The protective shelter of claim 11 wherein the arcuate-shaped cover includes a first portion of a hook and loop fastening system located proximate the elongated top-front structural member, the first portion configured to removably attach to a corresponding portion coupled to a front flap.

14. The protective shelter of claim 1 wherein the first side portion and the second side portion of the arcuate-shaped cover are substantially parallel to one another.

* * * * *